US009106995B2

(12) United States Patent
Nelson

(10) Patent No.: US 9,106,995 B2
(45) Date of Patent: Aug. 11, 2015

(54) REPOSITIONABLE CONTROL SYSTEM AND METHOD FOR USING THE SAME

(75) Inventor: Matthew Nelson, Studio City, CA (US)

(73) Assignee: APPLE INC., Cupertino, CA (US)

( * ) Notice: Subject to any disclaimer, the term of this patent is extended or adjusted under 35 U.S.C. 154(b) by 275 days.

(21) Appl. No.: 13/610,615

(22) Filed: Sep. 11, 2012

(65) Prior Publication Data

US 2014/0072137 A1 Mar. 13, 2014

(51) Int. Cl.
*H04R 1/10* (2006.01)

(52) U.S. Cl.
CPC ..... *H04R 1/1041* (2013.01); *H04R 1/1033* (2013.01)

(58) Field of Classification Search
CPC ..... H04R 2420/09; H01H 9/0207; H04B 2203/5429; H04B 2203/5462
See application file for complete search history.

(56) References Cited

U.S. PATENT DOCUMENTS

| | | | | |
|---|---|---|---|---|
| 5,902,148 | A * | 5/1999 | O'Rourke | 439/505 |
| 8,340,975 | B1 * | 12/2012 | Rosenberger | 704/275 |
| 2003/0002688 | A1 | 1/2003 | Kanevsky et al. | |
| 2005/0275969 | A1 * | 12/2005 | Kinouchi et al. | 360/137 |
| 2007/0098202 | A1 | 5/2007 | Viranyi et al. | |
| 2008/0172232 | A1 * | 7/2008 | Gurley | 704/251 |
| 2008/0278443 | A1 | 11/2008 | Schelling et al. | |
| 2009/0245550 | A1 | 10/2009 | Dai et al. | |
| 2010/0048135 | A1 | 2/2010 | Marten | |
| 2010/0128887 | A1 * | 5/2010 | Lee et al. | 381/74 |
| 2011/0230239 | A1 | 9/2011 | Ueda et al. | |
| 2013/0183944 | A1 * | 7/2013 | Mozer et al. | 455/414.1 |

FOREIGN PATENT DOCUMENTS

| | | |
|---|---|---|
| EP | 0475297 A2 | 9/1991 |
| GB | 2508265 A | 5/2014 |

OTHER PUBLICATIONS

Search Report for U.K. Patent Application No. GB1316148.4, dated Mar. 18, 2014; 1 page.

* cited by examiner

*Primary Examiner* — Daniell L Negron
(74) *Attorney, Agent, or Firm* — Ganz Pollard, LLC

(57) ABSTRACT

A system for controlling one or more functions of an electronic device is disclosed. The system includes an electrical cable configured to be selectively coupled to the electronic device and transmit electrical signals to and from the electronic device; at least two electrical conductors electrically coupled to the electrical cable; and a repositionable control device selectively coupled to the at least two electrical conductors. The repositionable control device is configured to control the one or more functions associated with the electronic device.

20 Claims, 5 Drawing Sheets

REPOSITIONABLE CONTROL SYSTEM AND METHOD FOR USING THE SAME

BACKGROUND OF THE INVENTION

The description that follows relates generally to a repositionable control system and method for using the same. In particular, the description relates to a repositionable control device for controlling functions associated with an audio listening device.

Audio listening devices (e.g., earphones, headphones, headsets, etc.) are widely used in connection with listening or play-back features of a multitude of electronic devices, including, for example, portable audio devices, portable media players, mobile telephones, smartphones, personal data assistants (PDAs), personal computers, exercise machines comprising a media player, and any other electronic device comprising a media player. Audio listening devices may have a wired and/or wireless (e.g., Bluetooth, radio frequency, WiFi, etc.) connection to an electronic device. For example, a wired audio listening device may include a wire or cable with a plug connector that is configured to be detachably coupled to an electronic device for receiving audio playback signals. In some commercially-available models, the audio listening cable may include a second plug connector for detachably coupling the audio listening cable with the audio listening device as well.

Many audio listening cables include a control unit that is attached to the cable itself. The control unit may enable a user to control one or more audio playback features, including, for example, volume level, track selection, play/pause, and the like. For example, the control unit may be positioned near a middle portion of the audio listening cable, so that the user may quickly and easily access, for example, the volume controls without accessing the electronic device attached to the cable. This is an especially convenient feature when the electronic device has been stored away in a pocket, shoulder bag, or other holder in order to keep the user's hands free.

Some commercially available audio listening devices include a microphone, for example, for carrying out a telephone conversation and/or implementation of voice command features in association with the attached electronic device. In some devices, the microphone may be attached directly to a headphone portion of the audio listening device, for example, on an extension member that brings the microphone closer to the mouth of the user. In other devices, the microphone is attached to the audio cable, for example, on an upper portion of the cable in order to optimally capture the user's voice signal. In some commercially available devices, the microphone is included in the same housing as the audio playback control unit, and the control unit may be used to control the microphone as well as the audio playback features mentioned above.

SUMMARY OF THE INVENTION

The invention is defined by the appended claims. This description summarizes some aspects of the embodiments and should not be used to limit the claims.

One embodiment includes a system for controlling one or more functions of an electronic device. The system includes an electrical cable configured to be selectively coupled to the electronic device and transmit electrical signals to and from the electronic device; at least two electrical conductors electrically coupled to the electrical cable; and a repositionable control device selectively coupled to the at least two electrical conductors. The repositionable control device is configured to control the one or more functions associated with the electronic device.

Other articles of manufacture, features, and advantages of the invention will be, or will become, apparent to one having ordinary skill in the art upon examination of the following drawings and detailed description. It is intended that all such additional articles of manufacture, features, and advantages included within this description be within the scope of the invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles described herein. In the drawings, like reference numerals designate corresponding parts throughout the several views.

Figures 1A, 1B:
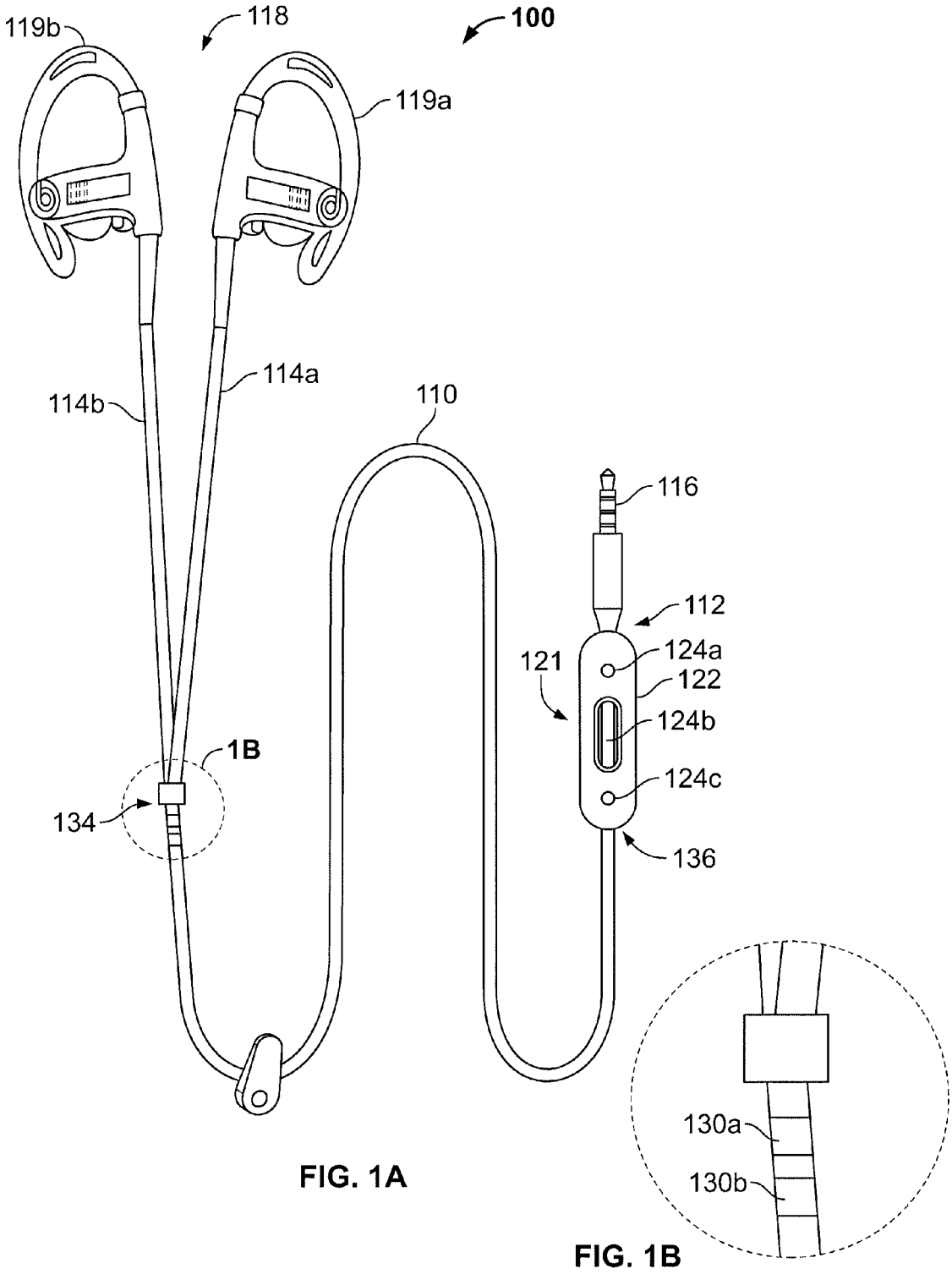
FIG. 1A is an illustration of an exemplary repositionable control system, including a repositionable control device and an electrical cable, in accordance with one embodiment.
FIG. 1B is a detailed view of a portion of the repositionable control system of FIG. 1A.

Illustrative and exemplary embodiments of the invention are described in further detail below with reference to and in conjunction with the figures.

DETAILED DESCRIPTION

The description that follows describes, illustrates, and exemplifies one or more particular embodiments of the invention in accordance with its principles. This description is not provided to limit the invention to the embodiments described herein, but rather to explain and teach the principles of the invention in such a way as to enable one of ordinary skill in the art to understand these principles and, with that understanding, be able to apply them to practice not only the embodiments described herein, but also other embodiments that may come to mind in accordance with these principles. The scope of the disclosure is intended to cover all such embodiments that may fall within the scope of the appended claims, either literally or under the doctrine of equivalents.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects.

A conventional control unit for an audio listening device may be bulky, bothersome and/or distracting for some users, especially when exercising, playing sports, or engaged in other physical activity. For example, when a jogger wears headphones having a control unit attached to the headphone cable, the control unit housing, as well as the headphone cable, may bounce around along with the user's movement. As a result, the attached housing may repeatedly strike or thump against, for example, the jogger's chest during the activity. As will be appreciated, the amount of force with which the housing hits the user depends on a level of active of the user wearing the headphones and/or the bulkiness of the control unit.

If, for example, a microphone device is included in the control unit, the housing may become even bulkier to accommodate the microphone circuitry and related elements. And the control unit may be positioned higher up on the headphone cable, e.g., to be closer to the user's mouth. As a result, a control unit housing that includes a microphone may bounce with more force and come closer to, perhaps even striking, the user's face, thereby increasing the user's annoyance with the control unit. While a user is unlikely to be harmed by the housing movement given the size and weight of a typical control unit, the user may be perturbed enough to opt for a different type of headphone while exercising. For example, the user may be forced to give up the convenience of having easily accessible volume control buttons, in exchange for a headphone system that does not strike the user while exercising.

As described in more detail below, the foregoing problems may be solved and a technical advance may be achieved by a repositionable control device that may be selectably moved from a first position on an electrical cable to a second position on the electrical cable, the electrical cable being coupled to an electronic device, such as, e.g., an audio listening system. The second position on the electrical cable may be specifically selected so that the repositionable control device does not inhibit a user while engaged in physical activity. And the electrical cable may be designed to enable operational coupling with the repositionable control device at the first position, and in some embodiments, at the second position as well. As exemplified, the electrical cable may be designed to enable operational coupling at any number of positions. Thus, a user of the repositionable control device described herein may have the convenience of an easily accessible control unit without having the inconvenience of being struck by the control unit housing while engaged in exercise or other physical activity.

Figure 2:
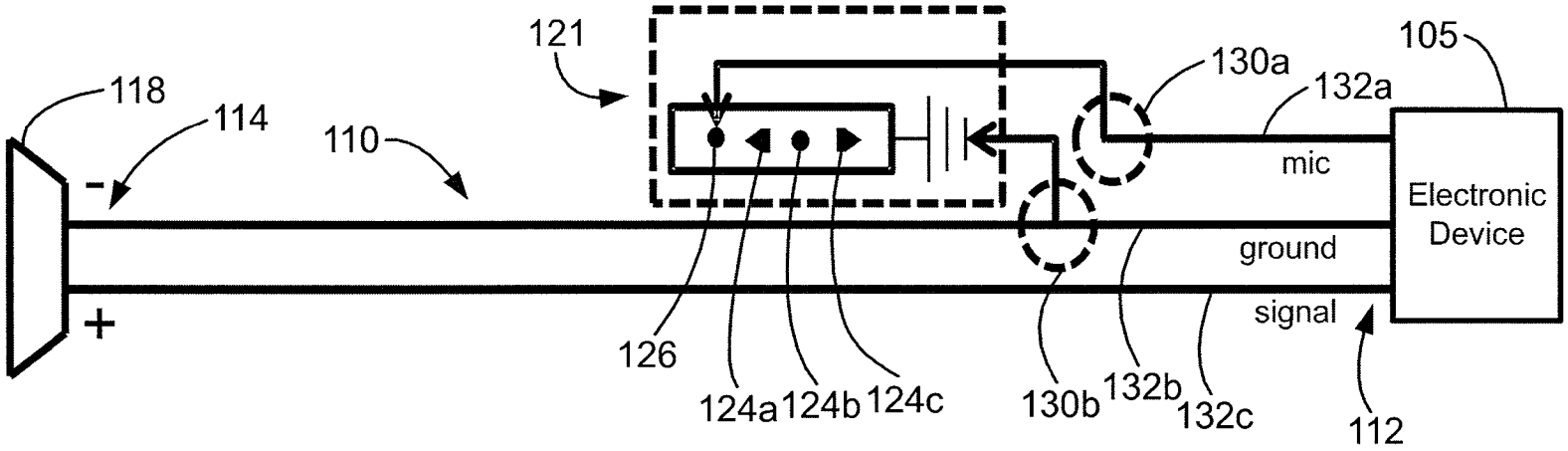
FIG. 2 is a schematic of the repositionable control system of FIG. 1A.

FIGS. 1 and 2 illustrate an embodiment of a repositionable control system 100 for controlling one or more functions of, for example, an electronic device 105 that is electrically coupled to an electrical cable 110 of the system 100. The electronic device 105 may include mobile telephone circuitry for accepting and making telephone calls, an audio source for playing music and other electrical audio signals, and/or computing circuitry for carrying out these and other functions associated with the electronic device 105. The electrical cable 110 may include a first end 112 and a second end 114. The first end 112 may include an electrical connector 116 for removable attachment of the electrical cable 110 to the electronic device 105. In one embodiment, the electrical connector 116 may be an audio plug, and the electronic device 105 may include an input jack (not shown) correspondingly dimensioned to receive the audio plug. The electrical connector 116 may be any type of detachable audio plug, including, but not limited to, a 6.35 mm stereo plug, a 3.5 mm stereo plug, a 2.5 mm stereo plug, a TS connector, a TRS connector, and/or a TRRS connector.

As shown in FIG. 2, in some embodiments, the electrical cable 110 may carry electrical audio signals and other electrical signals from the electronic device 105 attached at the first end 112 to an audio listening device 118 attached at the second end 114. The audio listening device 118 may reproduce the received electrical audio signals, such as, for example, music signals, through earpieces 119 for the listening pleasure of a user. In some embodiments, the system 100 includes the audio listening device 118 and the electrical cable 110 is a dedicated cable for the audio listening device 118. For example, the second end 114 of the electrical cable 110 may be fixedly attached to the audio listening device 118, so that the cable 110 and the device 118 form a single unit.

Figure 3:
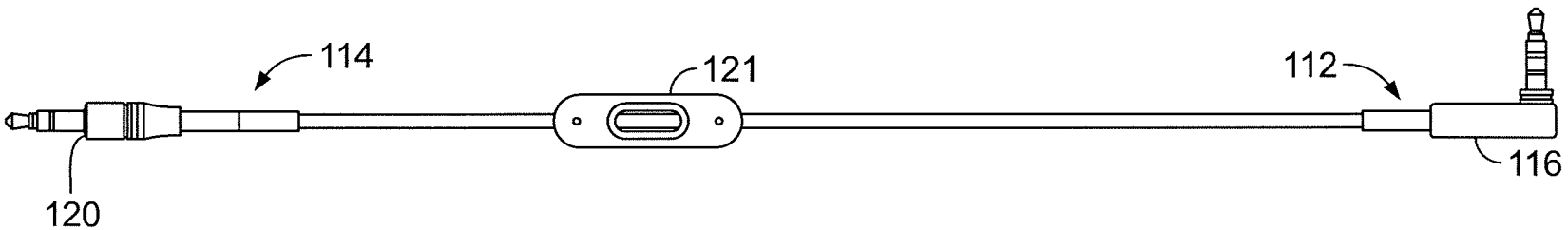
FIG. 3 is an image of an exemplary repositionable control system in accordance with a second embodiment.
Figure 4:
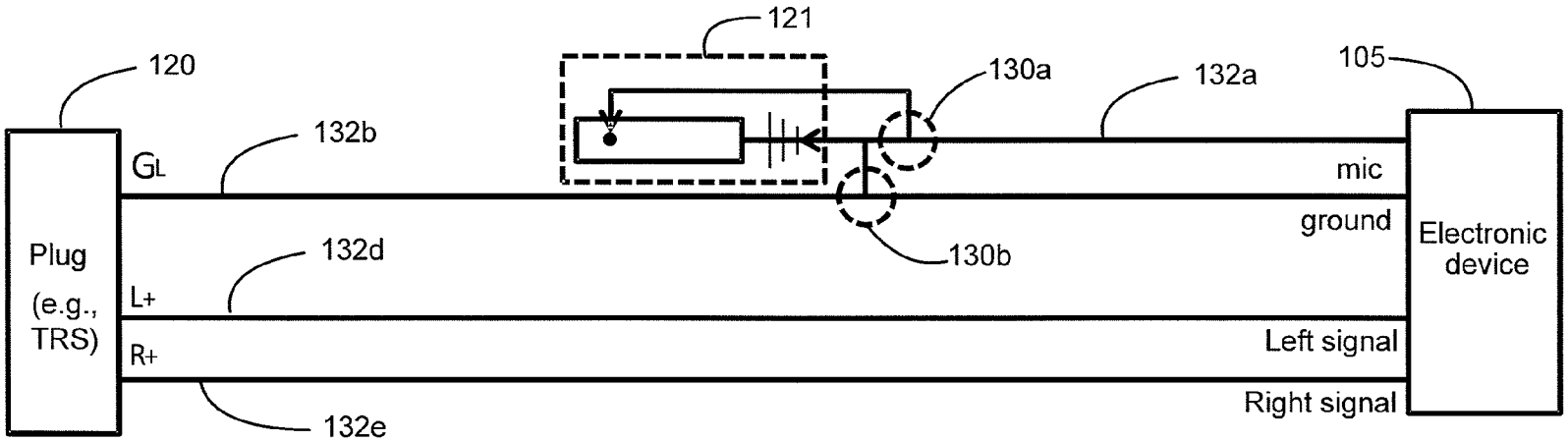
FIG. 4 is a schematic of an exemplary repositionable control system in accordance with another embodiment.
Figure 5:
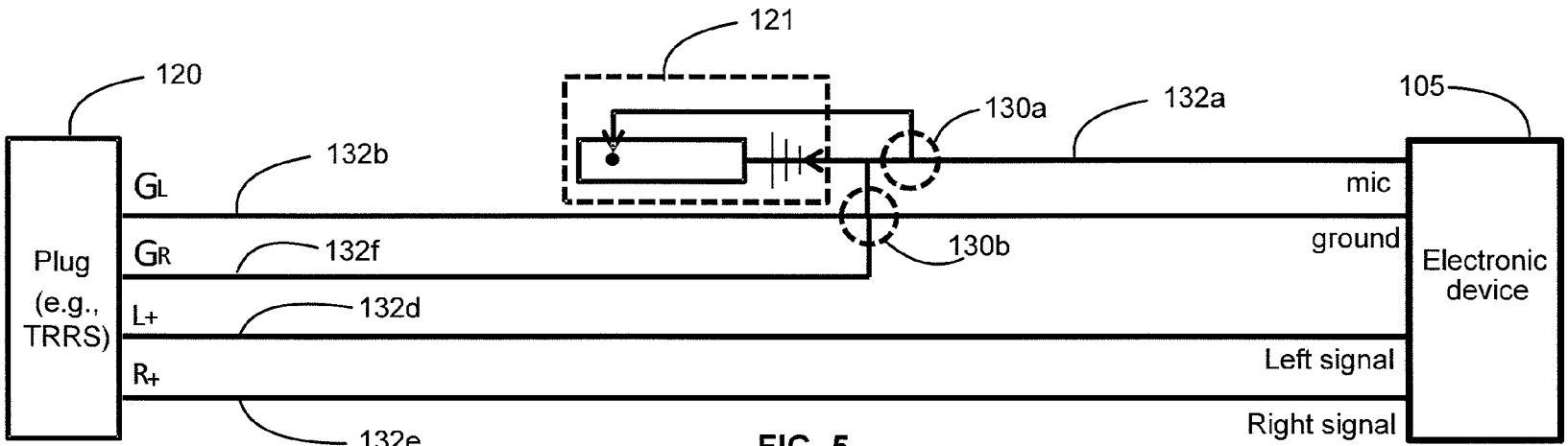
FIG. 5 is a schematic of an exemplary repositionable control system in accordance with yet another embodiment.

In other embodiments, such as the embodiments shown in FIGS. 3-5, the electrical cable 110 may be configured as a stand-alone or detachable cable that includes an electrical connector 120 on the second end 114 of the cable 110 for detachably coupling the audio listening device 118 thereto, in addition to the electrical connector 116 on the first end 112 for detachably coupling the electronic device 105 thereto. In one embodiment, the electrical connector 120 may be an audio plug, and the audio listening device 118 may include one or more input jacks (not shown) correspondingly dimensioned to receive the electrical connector 120. In such embodiments, the audio listening device 118 may or may not be included in the system 100. For instance, it may be desirable to not include the audio listening device 118 so that the system 100 may be used with a greater variety of audio listening devices 118, including any compatible devices that a user already owns.

The electrical connector 120 may be any type of detachable audio plug, including, but not limited to, a 6.35 mm stereo plug, a 3.5 mm stereo plug, a 2.5 mm stereo plug, a TS connector, a TRS connector, and/or a TRRS connector. The electrical connector 120 may be similar to or different from the electrical connector 116 included in the first end 112 of the electrical cable 110 for detachably coupling the electronic device 105 thereto. In some embodiments, the second end 114 of the electrical cable 110 may include at least two electrical connectors 120, each electrical connector 120 being associated with a respective one of the earpieces 119.

In FIG. 1A, the audio listening device 118 is shown only for illustrative purposes and is not intended to limit the system 100 in any manner. For example, the electrical cable 110 may be coupled to any type of audio listening device 118, including, but not limited to, headphones, earphones, earbuds, and the like. In one embodiment, the audio listening device 118 may include only one earpiece 119. In some embodiments, the audio listening device 118 may include an internal audio source for playing electrical audio signals, such as music signals, directly through the earpieces 119. In such an embodiment, the electrical cable 110 may carry, for example, other electrical audio signals from the electronic device 105 to the audio listening device 118, such as, for example, audio signals associated with video files, voice memos, email attachments, video games, etc. and/or telephone audio signals where the electronic device includes telephone circuitry.

As will be appreciated, the type of audio listening device 118 intended to be used with the system 100 may determine how the second end 114 of the electrical cable 110 is configured. For example, in FIG. 1A, the audio listening device 119 includes two earpieces 119*a* and 119*b*, and the cable 110 splits at a "Y" connector into two segments 114*a* and 114*b*, with segment 114*a* attaching to earpiece 119*a* and segment 114*b* attaching to earpiece 119*b*. In embodiments that include a detachable cable 110, each of the segments 114*a* and 114*b* may include an electrical connector 120 for detachably coupling the cable 110 to the earpieces 119. In another embodiment, the second end 114 of the electrical cable 110 may include a single detachable electrical connector 120, and the earpieces 119 of the audio listening device 118 may be electrically coupled to a single input port that is configured to be detachably coupled with the electrical connector 120. As another example, for a single-earpiece audio listening device 118, the earpiece 119 may be coupled to the electronic device 105 by a single cable 110.

Figure 6:
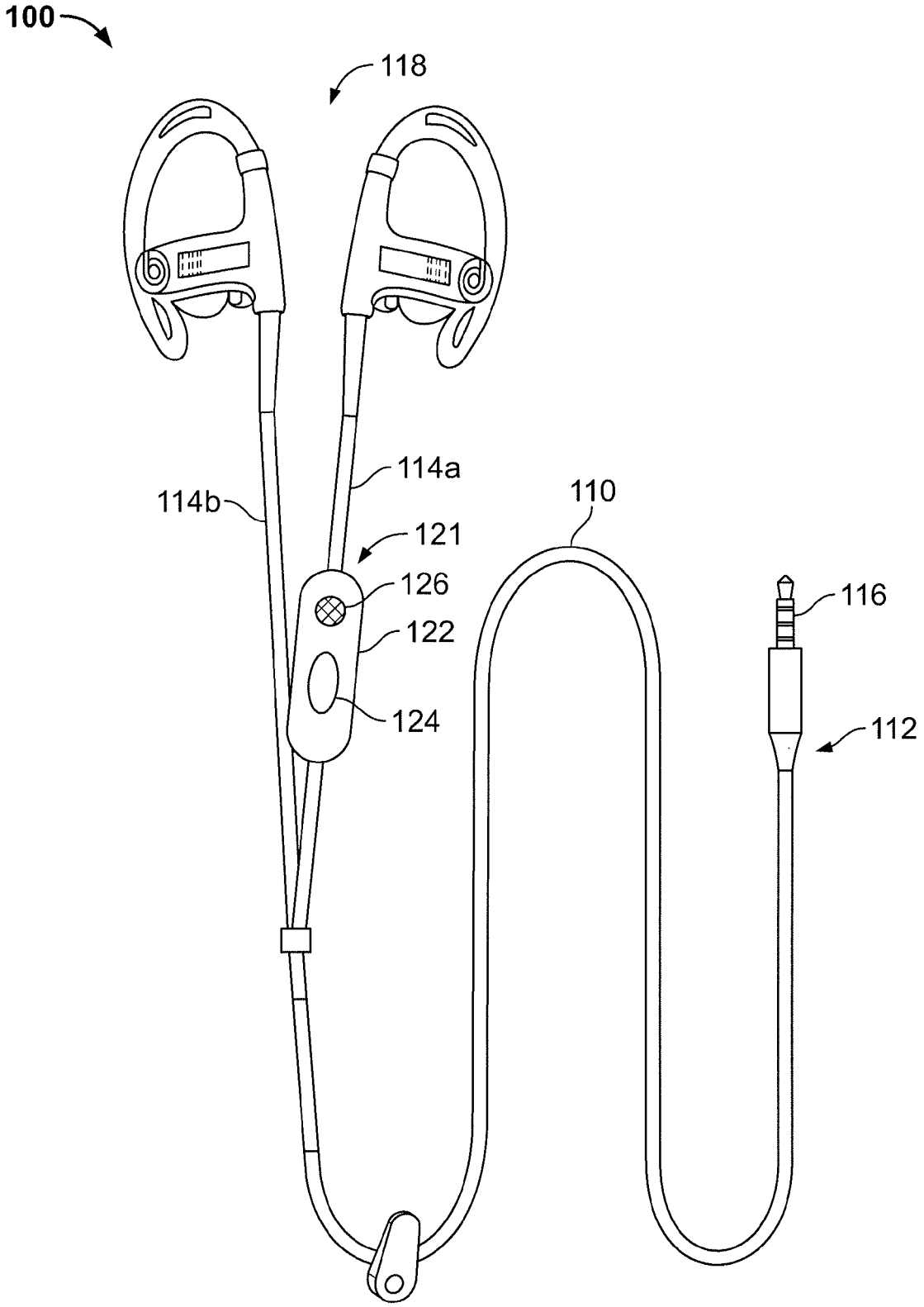
FIG. 6 is an illustration of an exemplary repositionable control system in accordance with a third embodiment.

In addition to the electrical cable 110, the system 100 may include a repositionable control device 121 that may be operationally and mechanically coupled to the electrical cable 110. According to the embodiment shown in FIG. 1A, the repositionable control device 121 may include a housing 122 and buttons 124 for receiving user input. While the embodiment of FIG. 1A includes three buttons 124, the repositionable control device 121 may have any number of buttons 124 in accordance with the present disclosure. For example, FIG. 6 shows an embodiment of the repositionable control system 100 that includes a repositionable control device 121 with a single button 124. In some embodiments, the repositionable control device 121 may also include a microphone 126 for capturing voice signals, for example, as shown in FIG. 6. In such embodiments, the repositionable control device 121 may be configured to enable a user to control one or more functions associated with the microphone 126, the audio listening device 118, and/or the electronic device 105 by pressing one or more of the buttons 124 and/or by speaking commands into the microphone 126.

As shown in FIGS. 1A and 1B, in some embodiments, the electrical cable 110 may include one or more electrical conductors 130 that are at least partially exposed on an external surface of the cable 110. In some embodiments, the electrical conductors 130 may be internally coupled to one or more channels 132 included in the electrical cable 110. For example, the electrical conductors 130*a* and 130*b* may be electrically coupled to a microphone channel 132*a* and a ground channel 132*b*, respectively, of the electrical cable 110, as shown in FIGS. 2, 4, and 5.

The number of channels 132 included in the electrical cable 110 may depend on the type of audio signal (e.g., mono or stereo sound) that may be played, for example, by an audio source included in the electronic device 105. As will be appreciated, the cable 110 may require more channels 132 for playing stereo sound signals than for playing mono sound signals. For example, in FIG. 2, the electrical cable 110 includes three channels, a microphone channel 132*a*, a ground channel 132*b*, and a signal channel 132*c*. Thus, the cable 110 of FIG. 2 may be used, for example, to play mono sound signals. As another example, FIG. 4 illustrates another embodiment of the electrical cable 110 that has four channels 132: the microphone channel 132*a*, the ground channel 132*b*, a left signal channel 132*d*, and a right signal channel 132*e*. And FIG. 5 illustrates yet another embodiment of the electrical cable 110 that has five channels 132: the microphone channel 132*a*, the left ground signal channel 132*b*, a right ground signal channel 132*f*, the left signal channel 132*d*, and the right signal channel 132*e*. The cable 110 of either FIG. 4 or FIG. 5 may be used, for example, to play mono or stereo sound signals, as there are dual-signal channels in either embodiment. As will be appreciated, the electrical cable 110 may include any number and/or type of channels 132 and is not limited to the illustrated embodiments.

Figure 7:
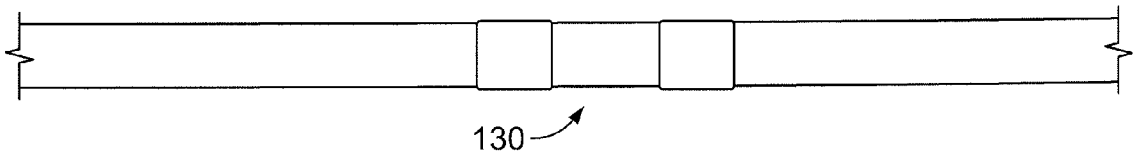
FIG. 7 is an image of an exemplary electrical cable in accordance with one embodiment.
Figure 8:
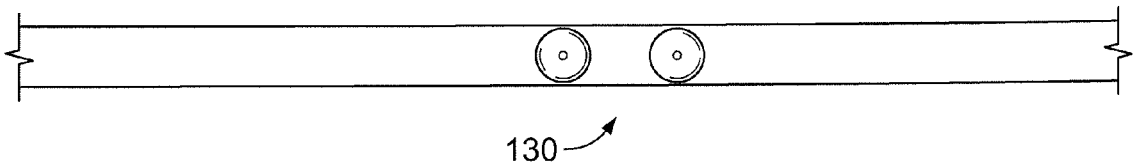
FIG. 8 is an image of an exemplary electrical cable in accordance with another embodiment.
Figure 9:
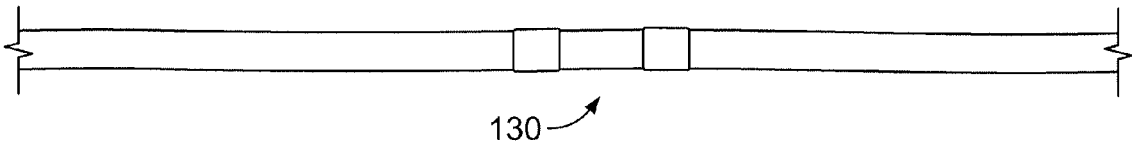
FIG. 9 is an image of an exemplary electrical cable in accordance with yet another embodiment.

As shown in FIGS. 7-9, the shape and size of the electrical conductors 130 may vary, for example, depending on the type of electrical cable 110 and/or depending on the mechanism used to attach the repositionable control device 121 to the electrical cable 110. As an example, in both FIGS. 7 and 8, the electrical cable 110 is shown as a flat cable. However, in FIG. 7 the electrical conductors 130 are shown as having a square shape, while in FIG. 8 the electrical conductors 130 are shown as having a circular shape. As another example, in FIG. 9, the electrical cable 110 is shown as a round cable, and the electrical conductors 130 are shown as having a rectangular shape and may wrap at least partially around the cable 110. As will be appreciated, the electrical conductors 130 may have any size or shape that fits on the particular electrical cable 110 and are not limited to the illustrated examples. In one embodiment, the electrical conductors 130 are exposed on only one side of the electrical cable 110. The electrical conductors 130 may be made of copper or any other conductive material.

The electrical conductors 130 may serve as an electrical interface between the electrical cable 110 and the repositionable control device 121, for example, when the control device 121 is attached to the cable 110. In some embodiments, the housing 122 of the repositionable control device 121 may comprise one or more electrical contact points, an external surface of which is exposed on a bottom surface (not shown) of the housing 122 and an internal surface of which is electrically coupled to control circuitry (not shown) included within the housing 122 of the control device 121. Upon attachment of the control device 121 to the cable 110, the external surface(s) of the electrical contact point(s) of the housing 122 may be substantially aligned with the exposed surface(s) of the electrical conductor(s) 130, so as to create an electrical connection or interface between the two surfaces. This interface may be used to send electrical signals between the repositionable control device 121 and, for example, the electronic device 105 using the electrical cable 110.

The electrical conductor(s) 130 are not limited to the above-described configuration and may be implemented according to other arrangements. For example, in one embodiment, the electrical conductor(s) 130 may be embedded into the electrical cable 110, and one or more opening(s) in the electrical cable 110 may provide access to the electrical conductor(s) 130. According this embodiment, the repositionable control device 121 may have one or more electrically conductive pins, or any other type of protrusion, attached to the bottom surface of the control device 121. The pin(s) may be dimensioned to fit within the opening(s) of the cable 110 so that when the pin(s) touch the electrical conductor(s) 130, an electrical interface may be created between the electrical cable 110 and the repositionable control device 121.

In one embodiment, the control circuitry within the repositionable control device 121 may generate a control signal in response to user input (e.g., user selection of button(s) 124 and/or user command via microphone 126) and may send the control signal to a pre-determined destination (e.g., electronic device 105, the microphone 126, and/or the audio listening device 118) through the electrical cable 110. In some embodiments, the control circuitry may include one or more electrical switches (not shown) for detecting user selection of the button(s) 124, such as, for example, a toggle switch, a push-button switch, a touch-sensitive switch, or any other type of switch that may be implemented within the repositionable control device 121. In one embodiment, for each button 124, the control circuitry may include an associated electrical switch. In some embodiments, user selection of the button 124 may cause a change in electrical continuity across the corresponding electrical switch. The control circuitry may be configured to detect the accompanying voltage change and generate an appropriate control signal for transmission to the electronic device 105, the audio listening device 118, and/or the microphone 126 via the electrical cable 110. In embodiments that include the microphone 126, the control circuitry may be electrically coupled to the microphone 126 within the housing 122 and may be configured to control electrical audio signals associated with the microphone 126. For example, the button 124 may be configured to enable a user to control operation of the microphone 126 in association with the electronic device and/or audio listening device 118.

In response to control signals received from the repositionable control device 121, one or more functions associated with the electronic device 105, the audio listening system 118, and/or the microphone 126 may be controlled, adjusted, or otherwise affected. For example, the repositionable control device 121 may be configured to enable control of a mute/unmute function, a volume control function, a call answer/reject function, a call hold function, a call start/end function, a power on/off function, a voice command on/off function, a track selection function, a track search function, a play/pause function, a select function, and any other function that may be associated with the system 100 and/or any components connected thereto.

According to some embodiments, a current operational mode of the system 100, the electronic device 105, the audio listening device 118, and/or the microphone 126 may determine which functions are controllable by the repositionable control device 121 at a given time. For example, in an embodiment where the electronic device 105 includes both mobile telephone circuitry and an audio source, the possible operational modes may include an incoming call mode, an active call mode, a voice command mode, an audio playback mode, an audio selection mode, or the like. In some embodiments, more than one operational mode may be simultaneously active. For example, the system 100 may be in the voice command mode while also being in the audio playback mode.

When in the audio playback mode (e.g., while music audio signals are being played through the audio listening device 118), in some embodiments, the electronic device 105 may determine that the button(s) 124 controls pre-assigned audio playback functions, such as, for example, the play/pause function, the volume control function, and/or the track selection function. In other embodiments, the button(s) 124 may be configured to control the voice command on/off function during the audio playback mode, in addition to or instead of the audio playback functions. As will be appreciated, the number of buttons included in the repositionable control device 121 may determine the number of functions that may be controlled thereby. For example, according to the embodiment shown in FIG. 1A, during the audio playback mode, the buttons 124*a* and 124*c* may be used to control the volume control function (e.g., volume up and volume down, respectively), while button 124*b* may control the play/pause function. In another example, where the repositionable control device 121 includes a single button 124, as shown in FIG. 6, the button 124 may be used to control only the play/pause function during the audio playback mode. As will be appreciated, the button(s) 124 may be used to control any of a number of functions, including, but not limited to, those described herein and any others that are known in the art.

When in the incoming call mode (e.g., upon detection of an incoming call), in some embodiments, the electronic device 105 may determine that the button(s) 124 controls, for example, the call answer/reject function and/or the voice command function. For example, in one embodiment, during the incoming call mode, a user selection of the button 124 and/or a voice command of "Accept" may generate a "call answer" command that may be sent to the electronic device 105. Upon receiving the call answer command, the electronic device 105 may switch the audio signals being played, for example, through the audio listening device 118 from music audio signals to telephone audio signals, thus entering the active call mode. In one embodiment, during the active call mode, the electronic device 105 may determine that the button(s) 124 controls pre-assigned telephone call functions, such as, for example, a mute/unmute function or a call end function. Upon detecting the end of the telephone call, the electronic device may automatically resume playing of the music audio signals through the audio listening device 118.

To enhance the control options for the repositionable control device 121 (regardless of whether it is a three-button control device as shown in FIGS. 1A and 2, a one button control device as shown in FIG. 6, or another configuration or number of buttons), in some embodiments, the system 100, the electronic device 105, the audio listening device 118, and/or the microphone 126 may be configured to detect different types and/or combinations of button depressions at the button(s) 124 and to correspondingly control different functions of the electronic device 105, the microphone 126, and/or the audio listening device 118. As an example, the different types of button depressions may include, but are not limited to, a standard button press, a short button press, a long button press, a double button press, a single button tap, a double button tap, and any other type of button depression lasting for a predetermined amount of time. For example, in one embodiment, a short press may be a press that lasts less than two seconds, a long press may be a press that lasts more than two seconds, and a double press may be two short presses of the button in short succession (e.g., less than one second between the two presses). As will be appreciated, the principles described herein are not limited to the exact amount of time associated with each type of button press or the exact type of button depression that is associated with controlling a particular function.

To illustrate how a user may operate the button(s) 124 of the system 100, in one embodiment, during the active call mode, the user may mute the call by a short press of the button 124 and may end the call by a long press of the same button 124. As another example, when simultaneously operating in the voice command mode and the audio playback mode, a short press of the button 124 may be associated with selection of the play/pause function from the audio playback mode, a long press of the button 124 may be associated with selection of the voice command on/off function from the voice command mode, and a double press of the button 124 may be associated with selection of the track search function from the audio playback mode. Other combinations of button depressions may be used to control the various functions associated with the system 100.

As mentioned above, in some embodiments, the system 100 and/or components connected thereto (e.g., the electronic device 105, the audio listening device 118, and/or the microphone 126) may be operating in the voice command mode at a given time. During the voice command mode, the microphone 126 may be used to capture voice signals that may be processed and converted into a control signal for controlling various functions associated with the system 100 and/or components connected thereto. For example, during the incoming call mode, the user may be prompted by the electronic device to speak "Accept" to answer the call or "Reject" to ignore the call. The microphone 126 may capture the user's voice command and, for example, using the electrical conductor 130*a* and the microphone channel 132*a* within the electrical cable 110, may transmit the voice signal to the electronic device 105 for speech detection and other signal processing. The microphone 126 may be any type of known microphone capable of being housed within the housing 122 and operating in association with the system 100, the electronic device 105 and/or the audio listening device 118. In one embodiment, the microphone 126 may be a MicroElectrical-Mechanical System (MEMS) microphone, a condenser microphone, a dynamic microphone, or any type of digital microphone.

The repositionable control device 121 may have configurations or combinations of components other than those illustrated in the figures and/or described above. For example, in some embodiments, the repositionable control device 121 includes at least one button 124 and no microphone. According to this embodiment, the repositionable control device 121 may still be used to control the system 100, the electronic device 105 and/or the audio listening device 118.

In some embodiments, the repositionable control device 121 may include an attachment mechanism (not shown) for attaching the housing 122 of the control device 121 to the electrical cable 110. The attachment mechanism disclosed herein allows the repositionable control device 121 to be selectively repositioned from a first position 134 on the electrical cable 110 to at least a second position 136 on the electrical cable 110.

In some embodiments, the first position 134 on the electrical cable 110 may be located in an upper portion of the electrical cable 110, closer to, for example, the second end 114 of the electrical cable 110. In an embodiment that includes the microphone 126, the location of the first position 134 may be selected to optimize voice signal detection and capture using the microphone 126. For example, in FIG. 6, the repositionable control device 121 is positioned on the segment 114*a* of the electrical cable 110. In this position, the microphone 126 may be closer to the user's mouth and easily extendable towards the user's mouth as needed. As will be appreciated, in such embodiments, the repositionable control device 121 may be positioned on either segment 114*a* or segment 114*b* of the electrical cable 110 to provide the same result. In another embodiment, the location of the first position 134 may be selected to provide easy and natural access to the control device 121 while the user is wearing the audio listening device 118. For example, in FIG. 1A, the repositionable control device 121 is positioned below the Y connector where the cable 110 splits into segments 114*a* and 114*b*.

In either embodiment, the second position 136 on the electrical cable 110 may be located, for example, in a lower portion of the electrical cable 110, closer to, for example, the first end 112 of the electrical cable 110. In FIG. 1A, the repositionable control device is attached to the electrical cable 110 at the second position 136. As an example, a user may prefer placing the control device 121 in the second position 136 while jogging or engaged in other physical activity, at least because while in the second position 136, the control device 121 may not strike the user's face or otherwise inconvenience the user during the activity. As will be appreciated, the present disclosure is not limited to an exact location of the first position 134 and/or the second 136 position.

In some embodiments, the first position 134 on the electrical cable 110 includes the electrical conductors 130, and the second position 136 does not include any electrical conductors 130. Accordingly, when in the first position 134, the control device 121 may be operationally coupled to the electrical cable 110 through the electrical conductors 130, and when in the second position 136, the control device 121 may not be operationally coupled to the electrical cable 110 (e.g., may not be used to control functions associated with the system 100). In such embodiments, for example, the second position 136 may be considered a storage position for the control device 121. In other embodiments, the second position includes a second pair of electrical conductors 130 for operationally coupling the repositionable control device 121 to the electrical cable 110. In such embodiments, the system 100 provides the user with two operational positions 134, 136 on the electrical cable 110 for attaching the repositionable control device 121. In other embodiments, instead of one or more predetermined attachment positions, the repositionable control device 121 may be repositioned onto any location on the cable 110. As will be appreciated, in such embodiments, at least one of the locations on the cable 110 will be an operational location (e.g., where the control device 121 is electrically coupled to the electrical conductors 130).

In some embodiments, the attachment mechanism may be a mechanical friction-based mechanism that uses frictional forces to hold the housing 122 in place on the cable 110. In one embodiment, the attachment mechanism may include, for example, a button that, when pressed, releases the frictional forces and allows the housing 122 to be moved to another position. To reattach the control device 121 to the electrical cable 110, the user may re-press the button on the attachment mechanism to re-apply frictional forces between the attachment mechanism and the cable 110. In one embodiment, the button on the attachment mechanism may be a spring-loaded button. In other embodiments, the attachment mechanism may use magnetic forces to hold the housing 122 in place on the cable 110. According to some embodiments, the attachment mechanism may be incorporated into and/or attached to the housing 122 of the repositionable control device 121. In other embodiments, the attachment mechanism may be partially included on the repositionable control device 121 and a remaining portion of the attachment mechanism may be included on the electrical cable 110.

In some embodiments, the attachment mechanism may be configured to allow complete detachment of the repositionable control device 121 from the electrical cable 110. For example, in one embodiment, the control device 121 may be entirely removed or detached from its position on the electrical cable 110 before being re-attached to a desired position on the electrical cable. In other embodiments, the attachment mechanism may be configured to slidably attach the repositionable control device 121 to the electrical cable 110. In such embodiments, for example, the repositionable control device 121 may be partially uncoupled or loosened from its position on the electrical cable 110 and slid up or down along the electrical cable 110 until reaching a desired recoupling position. In one such embodiment, the attachment mechanism may be configured to wrap around the electrical cable 110, so that at least a portion of the electrical cable 110 is always enclosed within the attachment mechanism.

In some embodiments, the housing 122 may include one or more openings through which a respective portion of the button(s) 124 may be exposed for user selection and, if present, a portion of the microphone 126 may be exposed for capturing voice signals. In one embodiment, the opening in the housing 122 for the microphone 126 may be located on an opposite side of the housing 122 than the openings for the button(s) 124. In another embodiment, all of the openings may be located on the same side of the housing 122. The housing 122 may be made of plastic or any other lightweight, non-conductive material.

It should be emphasized that the above-described embodiments, particularly, any "preferred" embodiments, are possible examples of implementations, merely set forth for a clear understanding of the principles of the invention. Many variations and modifications may be made to the above-described embodiment(s) of the invention without substantially departing from the spirit and principles of the invention. All such modifications are intended to be included herein within the scope of this disclosure and protected by the following claims.

What is claimed is:

1. A system for controlling one or more functions of an electronic device, the system comprising:

an electrical cable including a first coupler positioned at a first longitudinal position and a second coupler positioned at a second longitudinal position, and a plurality of electrical conductors extending between the first coupler and the second coupler and exposed to an outer surface of the electrical cable at the first coupler and the second coupler, wherein the electrical conductors are configured to selectively couple to an electronic device and to transmit electrical signals to and from the electronic device; and a repositionable control device selectively affixable to the electrical cable at each of the first longitudinal position and the second longitudinal position, wherein the second longitudinal position is spaced apart from the first longitudinal position, and the repositionable control device couples to one or more of the electrical conductors of the cable when the repositionable control device is affixed at either of the first longitudinal position and the second longitudinal position to control one or more functions associated with the electronic device.

2. The system of claim 1, wherein the repositionable control device includes one or more buttons, each button electronically configured to selectably control at least one of the one or more functions associated with the electronic device.

3. The system of claim 2, wherein the repositionable control device further includes a microphone.

4. The system of claim 3, wherein the repositionable control device includes at least one button that is electronically configured to selectably control one or more functions associated with the microphone.

5. The system of claim 1, wherein the repositionable control device includes an attachment mechanism configured to detachably couple the repositionable control device to the one or more of the electrical conductors.

6. The system of claim 5, wherein the attachment mechanism is configured to enable movement of the repositionable control device from the first longitudinal position to the second longitudinal position on the electrical cable.

7. The system of claim 6, wherein the attachment mechanism is configured to allow the repositionable control device to slide from the first longitudinal position to the second longitudinal position without completely detaching the repositionable control device from the electrical cable.

8. The system of claim 1, wherein the plurality of electrical conductors includes a set of electrical conductors corresponding to the first longitudinal position, the repositionable control device being coupleable to the set of electrical conductors corresponding to the first longitudinal position.

9. The system of claim 8, wherein the plurality of electrical conductors further includes a second set of electrical conductors corresponding to the second longitudinal position, the repositionable control device being coupleable to the second set of electrical conductors.

10. The system of claim 1, wherein the repositionable control device is configured to be completely detached from the electrical cable before being reattached to the electrical cable.

11. The system of claim 1, wherein the one or more functions associated with the electronic device includes at least one of a mute function, a volume control function, a track selection function, a pause function, a voice command function, an answer function, and a track search function.

12. The system of claim 1, wherein the electronic device is a mobile telephone.

13. The system of claim 1, wherein the electronic device includes a media player.

14. The system of claim 1, wherein the electrical cable is configured to be electrically coupled to a headphone system and to transmit electrical signals from the electronic device to the headphone system.

15. The system of claim 1, further comprising: a headphone system electrically coupleable to the electrical cable, the electrical cable configured to transmit electrical signals from the electronic device to the headphone system.

16. The system of claim 1, wherein at least one of the electrical conductors is exposed to a surface of the electrical cable.

17. The system of claim 1, wherein the plurality of electrical conductors comprises a set of electrical conductors corresponding to the first longitudinal position, wherein the control device is repositionably and electrically coupleable to the set of electrical conductors corresponding to the first longitudinal position.

18. The system of claim 17, wherein the set of electrical conductors comprises a first set of electrical conductors, wherein the plurality of electrical conductors further comprises a second set of electrical conductors corresponding to a second longitudinal position , wherein the control device is further repositionably and electrically coupleable to the second set of electrical conductors corresponding to the second longitudinal position, and wherein the first set of electrical conductors differs from the second set of electrical conductors.

19. The system of claim 1, wherein the cable defines a first major surface and an opposed second major surface, and wherein the first major surface defines the outer surface to which the plurality of electrical conductors is exposed.

20. The system of claim 19, wherein the outer surface to which the plurality of electrical conductors is exposed defines a flat surface.

* * * * *